United States Patent [19]

Parein

[11] Patent Number: 4,525,981

[45] Date of Patent: Jul. 2, 1985

[54] METHOD OF MAKING A BOOK OF MATCHES

[76] Inventor: Eric W. Parein, Faiderstraat 79, Elsene, Belgium, B-1050

[21] Appl. No.: 456,057

[22] PCT Filed: May 14, 1982

[86] PCT No.: PCT/BE82/00010

§ 371 Date: Jan. 5, 1983

§ 102(e) Date: Jan. 5, 1983

[87] PCT Pub. No.: WO82/03973

PCT Pub. Date: Nov. 25, 1982

[30] Foreign Application Priority Data

May 15, 1981 [BE] Belgium ..... 0/204805

[51] Int. Cl.[3] ..... C06F 1/26; A24F 27/12

[52] U.S. Cl. ..... 53/395

[58] Field of Search ..... 53/394, 395; 206/98, 206/99, 100, 134

[56] References Cited

U.S. PATENT DOCUMENTS 2,039,491 5/1936 Nolan ..... 53/395 X
2,097,839 11/1937 Leukhardt ..... 206/99

FOREIGN PATENT DOCUMENTS 886141 2/1981 Belgium .
1266104 5/1961 France .
104977 3/1917 United Kingdom .
465319 6/1937 United Kingdom .

*Primary Examiner*—E. Michael Combs
*Attorney, Agent, or Firm*—Diller, Ramik Wight

[57] ABSTRACT

Method and installation for the separate conditioning of matches (1) in a package subdivided in oblong compartments (4) wherein a match (1) is arranged in each of them, the compartments (4) being closed at one end and open at the opposite end so that the head (11) of a match is located at the closed end and the opposite portion of the match goes beyond the open end of the compartments (4) to allow for the removal of the match from its compartment. The matches (1) are first arranged in a relatively flat prismatic core (2) comprising oblong housings (4) for the matches, those housings being arranged one after the other and separate in their longitudinal direction by partitioning walls (3), the housings (4) being almost completely open along at least one of their longitudinal open sides (5), the sides (5) being then covered by a closure element (6) so that oblong compartments (4) are formed wherein the matches (1) are removably squeezed.

11 Claims, 5 Drawing Figures

FIG. 1
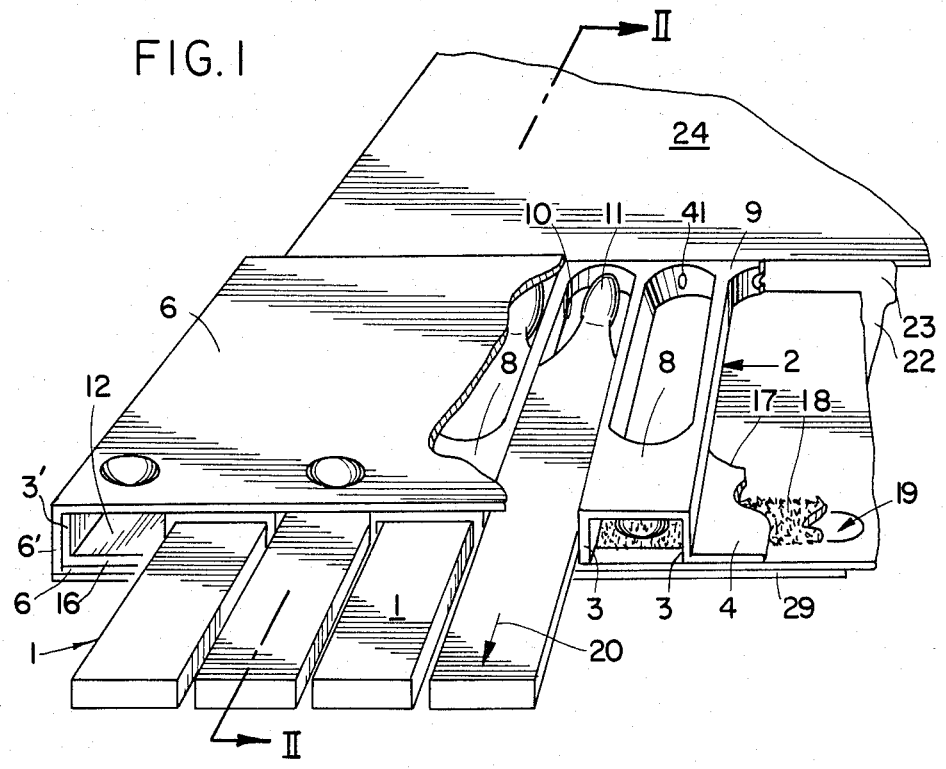
FIG. 2
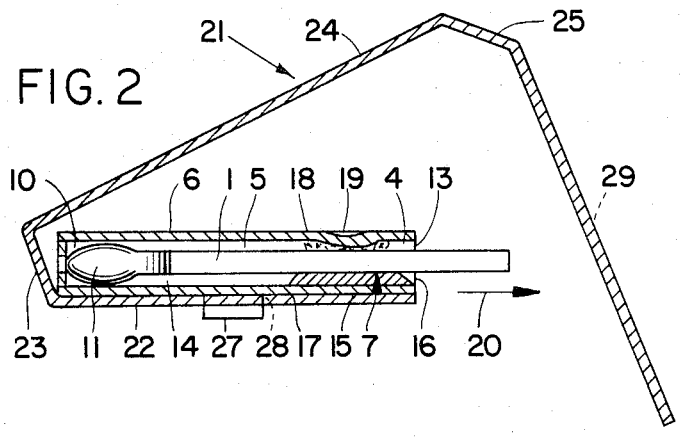
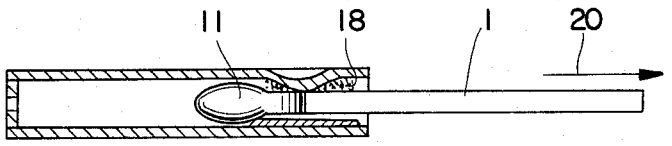
FIG. 3
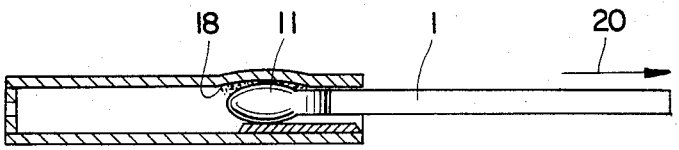
FIG. 4

METHOD OF MAKING A BOOK OF MATCHES

This invention relates to a method of separately conditioning matches in a package subdivided into oblong compartments in each of which is arranged a match, said compartments being closed at one end and open at the opposite end in such a way that the head of the match is located at the closed end and the opposite portion of the match projects beyond the open end of said compartments to allow for the removal of the match from its compartment.

More precisely, an object is to provide a method permitting a continuous commercial manufacture of match-filled packages in a very efficient and also simple way.

To this effect, matches are first inserted into a relatively flat prismatic core comprising oblong housings for the matches, which housings are situated one after the other and separated in their longitudinal direction by partition walls, said housings being almost completely open along at least one of their outer longitudinal sides, these open longitudinal sides being then covered by means of a closure element, in such a way that closed oblong compartments are formed along their longitudinal sides and that the matches are removably confined therein.

Conveniently, a core is used wherein the housings for successive matches are nearly completely open at one main face of the core and at the opposite face thereof in an alternating way, said closure element being formed then by a sheet which is adhered to the noncompletely open longitudinal sides of the housings situated in the above-mentioned two mutually opposed main faces of the core.

According to a special embodiment of the invention, a recess providing a sufficiently large space for the head of the match to be located therein is provided in the longitudinal side of the housings facing the almost completely open longitudinal side and at least at the location of the head of the matches.

In a preferred embodiment of the invention, the matches are moved into the housings of the core in longitudinal direction.

The invention also relates to an apparatus for the separate conditioning of matches and more precisely for effecting the above mentioned method.

This apparatus is characterized by the fact that it essentially comprises: conveyor means upon which a thin sheet of wood may be conveyed in its longitudinal direction, cutting means for the creation of teeth into at least one of the longitudinal edges of this sheet, a bath of liquid inflammable material, means for treatment of the wood and for impregnating the teeth with said bath, dividing means for dividing the sheet according to its cross-direction into narrow parallel sticks such that a head is present at at least one end of each stick, clamping means capable of retaining the sticks in relation to each other, pasting means for applying an adhesive to the outer side of the core, supply means for moving the cores onto the sticks in such a way that one of them will penetrate into each of the housings of the core, and covering means for adhering the closure element to the outer side of the core.

Further, the invention relates to the parallelepiped-shaped core and to the match package comprising such core and obtained by the method and/or with the aid of the apparatus described above.

Further particulars and further advantages of the invention will be clear from reading the following description of some specific embodiments of the invented method and apparatus; such description is only given by way of example and cannot restrict the invention. The reference numbers used hereinafter relate to the attached figures.

FIG. 1 is a perspective view, and partial section, of a match-filled package obtained by using the invented method.

FIG. 2 is a section along the line II—II of FIG. 1.

FIG. 3 is a section similar to FIG. 2 but wherein the match is in a first intermediate position.

FIG. 4 is also a section similar to FIG. 2 but wherein the match is in a final intermediate position.

In all these different figures, the same reference numbers relate to the same elements.

Figure 5:
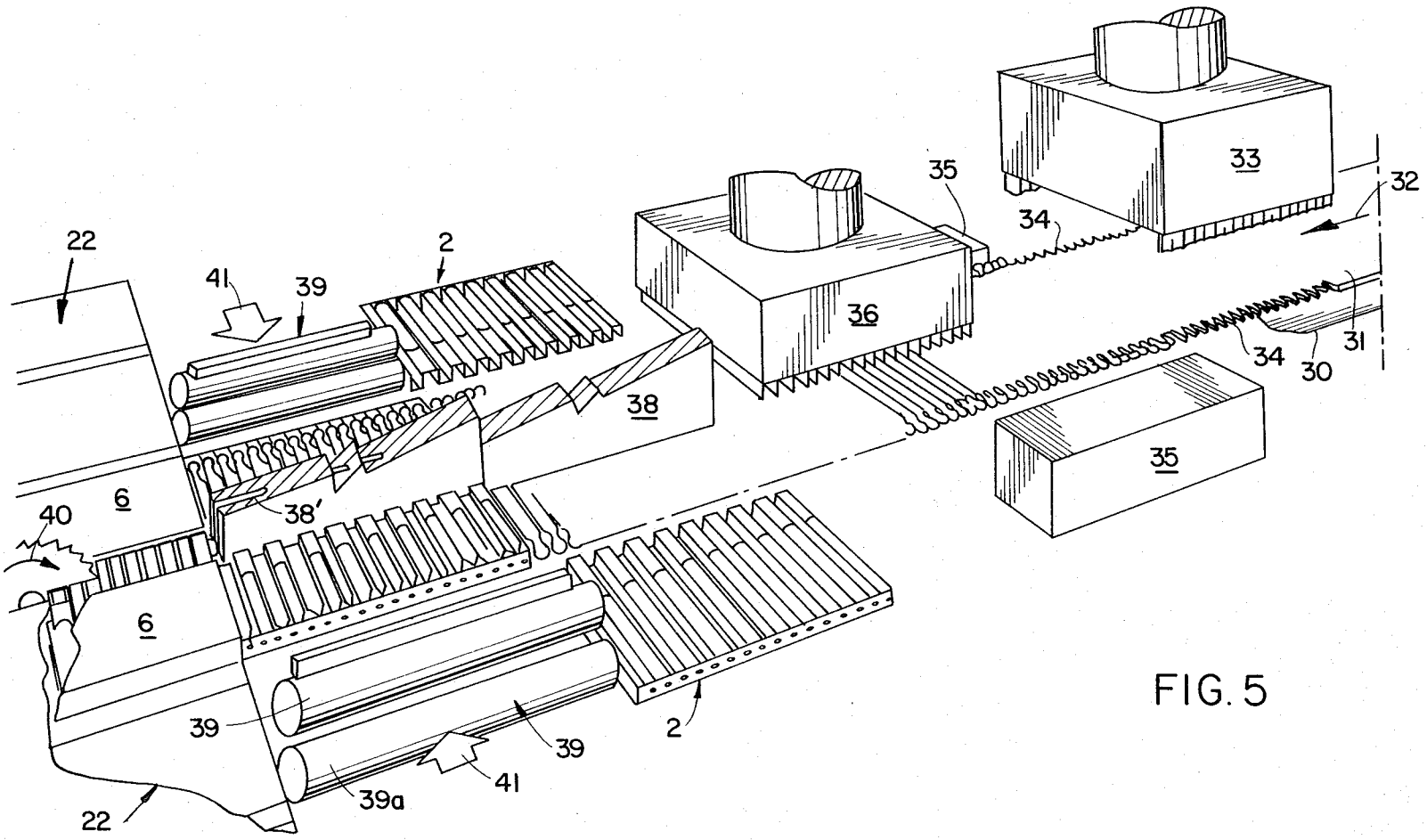
FIG. 5 is a schematic representation, in perspective view, of a special embodiment of the invented method and apparatus for the conditioning of matches.

The invented method of conditioning matches, as illustrated by the figures, is mainly composed of two important steps.

In a first step, matches 1 are inserted into a relatively flat prismatic core 2, preferably made from synthetic material and having a thickness which is only a little bit higher than the corresponding thickness of the match heads.

The core 2 comprises a series of successive oblong housings 4 separated from each other by partition walls 3 in their longitudinal direction and being completely open at one of their outer longitudinal sides such that there is no risk whatsoever for the matches to be clamped or broken at the moment that they are inserted into the housings 4 of the core 2.

Thereupon, in a second step, said open longitudinal sides 5 are covered by means of a closure element 6 in such a way that the matches 1 are removably confined in their corresponding housings 4.

In the embodiment as shown in the figures, use is made of a core 2 wherein the successive housings 4 for the matches have alternating open sides in one main face of the core and in the opposite face thereof. Moreover, the housings 4 which are all identical, are rectangular in cross-section and have short sides extending along the partition walls 3. Thus, in a cross-section perpendicular to the partition walls 3, the core has more or less a crenolated aspect.

The closure element 6 is in the form of a sheet, preferably of cardboard, which by means of an adhesive 8 is adhered to the non completely open longitudinal sides 7 of the housings 4, at both said mutually opposite main faces of the core 2, therefore in such a way that these sheets 6 will extend on the whole surface of these both faces and will form oblong compartments 12 which are closed along their longitudinal sides and wherein the matches are removably confined.

At the location of the end walls 3' of the core 2, the closure element has a flap 6' which is adhered to the outer side of this wall 3'. A similar flap 6' is provided at the closure element which covers the open side 5 of a terminal housing 4 of the core 2.

Further, the core has a wall 9 which closes the housings at their ends at the location of the space 10 where the head 11 of the matches 1 should be located.

The opposite end 13 of the housings 4 is open in such a way that the matches may project laterally from the core at this location.

A recess 14 is provided in the longitudinal side 7 of the housings 4 and extends from the wall 9 through the space 10 for the match head 11 in the direction of the end 13 of the housings, in such a way that this recess will cover about ⅔ of the surface of side 7. The remaining part 15 of this longitudinal side 7 acts as a supporting surface for the match and is provided with two bevelled edges 16 and 17.

The bevelled edge 16 at the entrance of the housings 4 allows the matches during their penetration into the housings to be guided along their supporting surface 15. The thickness of the side 7 at the location of the supporting surface is substantially equal to half of the difference between the thickness of the match head and of the match stick.

A striking strip 18 for the matches is provided at the side of the closure element 6 directed towards the housings 4. This striking strip is located near the end 13 of the housings.

Further, the closure element 6 has a raised part 19 in its side directed towards the housings 4, said raised part bearing elastically on the matches. In the embodiment of FIGS. 1 to 4, this raised part is a dent in the outer surface of the closure element 6 and it substantially corresponds to the thickness of side 7 at the location of the supporting surface 15.

In the embodiment of FIGS. 1 to 4, the striking strip 18 extends along the raised part 19.

The raised part 19 is located opposite to the supporting surface 15 but in such a way that the bevelled edge 17 is located closer to the wall 9.

Thus, two separate stages or movements can be distinguished during withdrawal of a match from a compartment 12 in the direction of arrow 20.

In a first stage or movement, the match is moved substantially without frictional resistance until reaching the position shown in FIG. 3, that is until the moment that the head 11 reaches the bevelled edge 17. This bevelled edge is located such with regard to the striking strip 18 that the head 11 does not yet reach the latter in this position.

In a second stage or movement, the head 11 slides along the bevelled edge 17 and presses against the closure element 6 which faces it and which is somewhat deformed. Due to this fact, a relatively high resistance is created and a higher traction force should be applied to the match for withdrawing it further from its compartment. A consequence thereof is that the head 11, as soon as the resistance has been overcome, will rapidly slip through between the supporting surface 15 and the raised part 19 and that inflammation is produced only at the moment that the match has already left the compartment. Therefore, combustion can never take place at the interior of the compartment and any risk of inflammation of the package is excluded.

The raised part 19 has a double function: at one hand it ensures that the matches are always kept in the same position with regard to each other in the compartments 12, and at the other hand, the surface of contact between head 11 and striking strip 18 is increased, as can be seen clearly from FIG. 4.

Nevertheless, this raised part is not absolutely necessary and may be omitted, if desired.

The matches are rectangular in cross-section and the longer side thereof extends parallel to the closure element 6 in such a way that the free ends of the matches, projecting from the core, will form a nearly continuous surface suitable for receiving publicity, if desired.

Moreover, the longer side of the rectangular cross-section of the matches is larger than the corresponding thickness of the head 11, in such a way that the latter cannot be clamped when pushed into the housings of the core.

The invented package is completed by a cover 21 which may comprise five successive panels 22,23,24,25 and 26, in which case panel 22 is adhered to the outer side of one of the closure elements 6 and the other panels are capable of being folded around the core 2 in such a way that panel 26 will contact the outer side of the closure element.

In order to close cover 21 around the core 2, a button 27 is attached between panel 22 and the closure element 6 to which panel 22 is adhered, in such a way that this button will project through a corresponding hole 28 provided in said panel 22. Further, panel 26 has a hole 29 and the border of this hole will fit around button 27 when cover 21 has been closed around the core 2.

If desired, panel 22 may be adhered directly to the core 2 and in that case it will be a closure element 6 as well. Panel 22 itself is provided then with a striking strip 18.

The embodiment shown in FIGS. 1–4 may have the advantage that cover 21 need not necessarily be arranged at the moment of packaging the matches in the core.

Thus, semi-finished packages including a core and matches arranged between two closure elements 6, might be laid up in store. Covers 21 provided with any publicity could then be applied later on according to demand.

Anyway, the matches are confined in the core 2 by means of the closure elements 6 and a product easy to handle is obtained.

Moreover, according to the invention, this matter can be used as a finished product which may for instance be removably placed onto a support, e.g. in a car, in combination with an ashtray etc.

FIG. 5 is a schematic representation of a special embodiment of the invented method and apparatus.

This apparatus comprises essentially: conveyor means, more in particular a platen 30, on which a thin sheet of wood 31 may be moved in its longitudinal direction indicated by arrow 32; cutting means 33 for creating teeth 34 in both longitudinal edges of the sheet 31; baths and means 35 (known per se) for treating the wood and for impregnating the wood and the teeth with such baths; dividing means 36, preferably chopping means, for dividing the sheet 31 into narrow parallel sticks 37 in such a way that a tooth is present at each end of such sticks; clamping means 38 for retaining the sticks in relation to each other; pasting means 39 for applying an adhesive 8 to the outer sides of the cores; supply means (not shown) for pushing cores 2 onto both ends of the sticks 37 in such a way that a stick will penetrate into each of the housings of these cores; covering means (not shown) for adhering the closure element 6 and if desired, the cover 22 to the outer side of the core; and finally sawing means 40 permitting to saw the sticks 37 in the middle to form matches 1 of suitable length.

During the sawing step, the sticks 37 are preferably retained by the clamping means 38 and to this effect, the latter has a groove 38' into which the saw 40 may penetrate during progression of this clamping means.

If chopping means are used, it may be necessary to follow up the latter by distributing means (not shown)

for bringing the sticks 37 at mutual distances which substantially correspond to the wall thickness of the partition walls 3 of the cores 2.

Preferably, the clamping means 38 may also function as a stop for the cores during movement of the latter along the sticks in the direction of arrows 41. Thus, care is taken that the matches will always have the same relative position within the cores.

The pasting means 39 may e.g. comprise two rollers 39*a* and 39*b* mounted one above the other (one being driven) and capable of engaging an empty core between them.

The cylindrical surfaces of these rollers are continuously coated with adhesive. Thus, the pasting means permit, apart from applying adhesive 8 to the cores, to move the latter at the same time in the direction of arrows 41 towards to the clamping means.

The thickness of the sheet of wood 31 corresponds to the smallest thickness of the matches. This sheet may be continuous or may be composed of separate pieces having e.g. a length equal to a multiple of the length of a core. In the latter case, the conveyor means may e.g. be a conveyor belt which moves in a discontinuous way in the direction of arrow 32.

In the supply means, the cores may either be moved separately into the sticks at either side of the conveyor means, as shown schematically in FIG. 3, or by groups of five or ten or more cores which are closed up along the conveyor means and which are moved together onto a corresponding number of sticks. The striking strip 18 might as an alternative be present at the outer side of the package.

Forming the raised part 19 at the inner side of the closure element 6 is preferably effected after adhering this closure element to the core 2.

This raised part permits, interalia, to retain the matches within the compartments 12 at the same relative position with regard to each other.

The striking strip 18 is preferably continuous at the inner side of the closure element 6.

If desired, use may be made of a sheet of wood 31 having a width substantially corresponding to the length of one single match. In that case, only one of the longitudinal edges is provided with teeth 34 and the supply means for moving the cores onto the sticks, is present along one side of the sheet.

The baths and means 35 for treating the wood and for applying an inflammable substance to the teeth 34 may consist of those which are now used in the traditional methods of manufacturing matches. Thus, this treatment may include the following steps: immersing the sheet or the chopped sticks into a phosphate bath to prevent pulverisation of the ashes, immersing them into paraffin to permit a regular progression of the flame, drying the immersed sheet or sticks, etc.

Finally, from a publicity point of view, it is possible to provide holes 41 in the oblong compartments 12, e.g. through the wall 9 of the core 2, so that a certain noise through these holes is produced when an air flow is applied from the opposite open end of these compartments, and so that the empty package may be used as a mouth organ, if desired.

Preferably, this is only used in packages where the striking strip 18 is at the outside of the compartments 12 and where it may be removed in a simple way, if desired, if all matches have been used. This striking strip may preferably cover said holes.

As shown in the specification, the method of manufacturing matches and the step of inserting them into the invented package may be effected in a continuous way. Moreover, any waste of wood is restricted to a strict minimum.

Of course, the invention is not limited to the embodiments described above of the method and apparatus for separately conditioning matches, and many variants may be considered within the frame work of the invention, e.g. with relation to the different devices used. Moreover, the shape of the cores may be subject to many modifications. Thus, inter alia, the recess 14 might be rectangular and might be restricted to the space 10 for the head of the match, thus creating a longer support surface 15. Further, if desired, use might be made of wood of inferior quality or of wood types that have less waste, or of another material such as a synthetic resin, for manufacturing the matches, since these matches are only subjected to a simple traction force along their longitudinal axis during the striking step. Therefore, the matches may be less strong than those matches which are to be rubbed along the striking strip under a certain angle.

I claim:

1. The method of making a book of matches, which comprises the steps of:

(a) providing a sheet-like succession of separate matches having heads at one end thereof;

(b) relatively inserting said sheet-like succession of matches head end first and longitudinally into a succession of recesses of a relatively flat matchbook case having opposite faces;

(c) preparing matches of said succession for automatic striking in response to longitudinal withdrawal from their recesses by affixing at least one sheet carrying striking material to one of the opposite faces of said core.

2. The method as defined in claim 1 wherein the insertion of the succession of matches in step (b) is effected simultaneously.

3. The method as defined in claim 1 or 2 wherein all of the matches of said succession are prepared for striking in step (c) by affixing a sheet carrying striking material to both of the opposite faces of said core.

4. The method of making a book of matches, which comprises the steps of:

(a) providing a relatively flat matchbook core of undulated form which defines a series of recesses each of which is open at one end, closed at its opposite end, completely open along one face of the core and partially open along the opposite face of the core adjacent said closed end so as to provide a troughlike portion adjacent said open one end;

(b) providing a series of headed matches;

(c) inserting the series of matches head first into the open ends of said recesses until the heads thereof lie adjacent said closed ends of the recesses and the free ends of the matches protrude from said open ends of the recesses:

(d) providing a first sheet portion having regions of striking material located thereon to register opposite the troughlike portions exposed on one face of the core and a second sheet portion having regions of striking material located thereon to register opposite the trough-like portions exposed on the other face of the core; and securing said sheet portions respectively over the opposite faces of said core to close off said recesses except at said open ends and with the striking material regions thereof registered with said trough-like portions to allow a match to be withdrawn from its recess while being ignited in the process.

5. The method as defined in claim 4 wherein the core is provided in step (a) from synthetic resinous material.

6. The method as defined in claim 4 including the step of deforming the sheet portions of step (d) out of the planes of the sheets in those regions thereof where the striking material is located for registry with the trough-like portions.

7. The method for continuously making matchbooks, which comprises the steps of:

(a) advancing a thin web of wood having an indefinite length;

(b) forming teeth along at least one side edge of the web;

(c) forming match heads on said teeth;

(d) splitting the web transversely between the match heads to form a sheet of separate match sticks each having a match head on at least one end;

(e) clamping the sheet of match sticks to retain the integrity of such sheet of sticks;

(f) relatively inserting successive series of the match sticks, lengthwise and head end first, into a corresponding series of relatively flat matchbook cores which are of lesser widths than the length of said match sticks; and (g) preparing matches of each series for automatic ignition in response to longitudinal withdrawal therefrom from said cores by affixing at least one sheet carrying striking material to one of the opposite faces of said cores.

8. The method as defined in claim 7 wherein each series of match sticks in step (f) is inserted simultaneously into a core.

9. The method as defined in claim 7 or 8 wherein all of the matches of each series are prepared for striking in step (g) by affixing a sheet carrying striking material to both of the opposite faces of each core.

10. The method as defined in claim 7 including, in step (b), forming teeth along both side edges of the web, and including the step of severing the two matches of each stick.

11. The method as defined in claim 10 wherein the step of severing is effected subsequent to the preparation of step (g).

* * * * *